US007543564B2

(12) United States Patent
Holm et al.

(10) Patent No.: US 7,543,564 B2
(45) Date of Patent: Jun. 9, 2009

(54) REVERSE ROTATION INTAKE MANIFOLD PROTECTION SYSTEM AND METHOD

(75) Inventors: Eric Ralph Holm, Brighton, MI (US); Jason Thomas Davis, Williamston, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/332,921

(22) Filed: Jan. 17, 2006

(65) Prior Publication Data

US 2007/0163556 A1 Jul. 19, 2007

(51) Int. Cl.
*F02P 11/00* (2006.01)

(52) U.S. Cl. ..... 123/406.62; 123/198 DB

(58) Field of Classification Search ..... 123/198 D, 123/198 DB, 198 DC, 406.62, 479, 631, 123/406.47

See application file for complete search history.

(56) References Cited

U.S. PATENT DOCUMENTS 5,622,153 A * 4/1997 Ott et al. ..... 123/179.5
6,438,487 B1 * 8/2002 Mingo et al. ..... 701/113
6,691,690 B2 * 2/2004 Shin ..... 123/631
6,732,713 B1 * 5/2004 Kanazawa et al. ..... 123/631
6,786,212 B1 * 9/2004 Choi ..... 123/631
6,810,724 B2 * 11/2004 Kimata et al. ..... 73/116
7,185,628 B1 * 3/2007 Holm et al. ..... 123/319
2003/0164152 A1 * 9/2003 Iwasaki et al. ..... 123/319
2004/0112124 A1 * 6/2004 Sonnenrein et al. ..... 73/118.1

FOREIGN PATENT DOCUMENTS

JP 2002-195070 * 7/2002

* cited by examiner

*Primary Examiner*—Hieu T Vo

(57) ABSTRACT

A method of protecting an intake manifold of an engine of a hybrid propulsion system including an electric motor comprises detecting a reverse rotation of an engine. A fuel injector of the engine that is rotating in reverse is commanded to cease operation. A spark plug of the engine that is rotating in reverse is commanded to cease operation. The ceasing of reverse rotation of the engine is then confirmed.

19 Claims, 3 Drawing Sheets

REVERSE ROTATION INTAKE MANIFOLD PROTECTION SYSTEM AND METHOD

FIELD OF THE INVENTION

The present invention relates to internal combustion engines, and more particularly to systems and methods for protecting an intake manifold during reverse engine rotation.

BACKGROUND OF THE INVENTION

An internal combustion engine generally operates in four modes; an intake mode, a compression mode, a combustion mode and an exhaust mode. During reverse rotation of an engine, the engine cycle executes in a reverse order whereby the compression mode is followed by the intake mode. For example, when an engine that is stopped begins to start again, the engine may have a cylinder that was in a compression mode at the moment of stopping. Compression pressure in the cylinder may push a piston in reverse toward bottom dead center (BDC). When engine speed increases, a cylinder with injected fuel may experience ignition and the reverse rotation may be accelerated.

Conventional engines will rarely rotate in reverse for long periods of time. Torque control systems are capable of limiting the duration of the reverse rotation. However, the problem arises more frequently in hybrid electric propulsion systems. An external force (such as an electric motor) can rotate the internal combustion engine in reverse for longer durations at higher speeds. Conventional torque control systems are not able to control torque under these conditions.

If reverse rotation occurs, engine components such as the intake manifold can be damaged. Reverse rotation may cause a compressed air/fuel mixture to flow back into the intake manifold during the intake stroke through an open intake valve. Pressure in the intake manifold increases. If further reverse rotation occurs, pressure may increase further and cause damage to the intake manifold.

In addition to damage to the intake manifold, reverse rotation of the engine may cause further problems such as excess bearing wear and damage to gaskets, hoses and sensors connected to the intake manifold.

SUMMARY OF THE INVENTION

A method of protecting an intake manifold of an engine of a hybrid propulsion system including an electric motor comprises detecting a reverse rotation of an engine. A fuel injector of the engine that is rotating in reverse is commanded to cease operation. A spark plug of the engine that is rotating in reverse is commanded to cease operation. The ceasing of reverse rotation of the engine is then confirmed.

In another feature, the method comprises notifying a diagnostic module of the reverse rotation.

In another feature, an electric motor is commanded to cease operation after detecting reverse rotation is performed, wherein commanding the electric motor to cease operation further comprises commanding the electric motor to begin forward rotation.

In another feature, the method comprises commanding the fuel injector to re-enable and commanding the spark plug to re-enable after confirming of the ceasing of reverse rotation of the engine is performed.

In other features, detecting reverse rotation comprises comparing an actual cam sensor signal to an expected cam sensor signal. Wherein the expected cam sensor signal is determined based on the actual cam sensor signal and a crankshaft sensor signal.

In other features, the expected cam sensor signal is set to a previously stored actual cam sensor signal, and wherein detecting reverse rotation further comprises comparing a state of the actual cam sensor signal to a state of the expected cam sensor signal while the engine is operating in at least one of a first region and a second region and when a camshaft and crankshaft are synchronized.

In still other features, the expected cam sensor signal is set to an expected reverse cam sensor signal, and wherein detecting reverse rotation further comprises comparing an edge of the actual cam sensor signal to an edge of the expected cam sensor signal for a selected crank angle region relative to top dead center of a specified cylinder when a camshaft and crankshaft are not synchronized.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
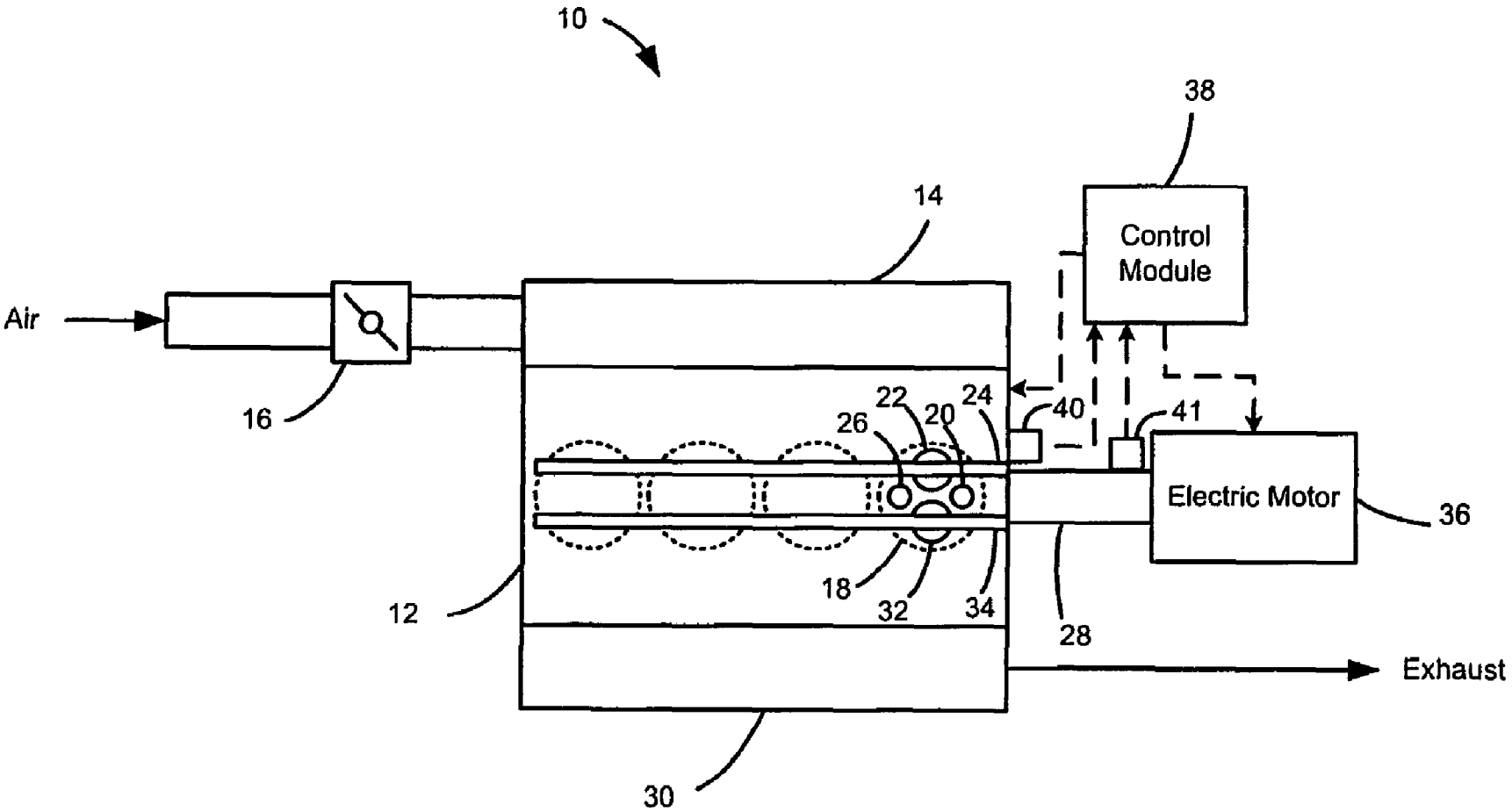
FIG. 1 is a schematic illustration of a hybrid propulsion system including the intake manifold protection system according to the present invention.

The following description of the preferred embodiment(s) is merely exemplary in nature and is in no way intended to limit the invention, its application, or uses. For purposes of clarity, the same reference numbers will be used in the drawings to identify the same elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an engine propulsion system 10 includes an engine 12 that combusts an air and fuel mixture to produce drive torque. Air is drawn into an intake manifold 14 through a throttle 16. The throttle 16 is electronically controlled to regulate mass air flow into the intake manifold 14. Air within the intake manifold 14 is distributed into cylinders 18. Although four cylinders 18 are illustrated, it can be appreciated that the engine propulsion system of the present invention can be implemented in engines having a plurality of cylinders including, but not limited to, 2, 3, 5, 6, 8, 10, 12 and 16 cylinders.

A fuel injector 20 injects fuel that is combined with the air as it is drawn into the cylinder 18 through an intake port. An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 initiates combustion of the air/fuel mixture, driving the piston in the cylinder 18. The piston drives a crankshaft 28 to produce drive torque.

Combustion exhaust within the cylinder 18 is forced out through an exhaust manifold 30 when an exhaust valve 32 is in an open position. The exhaust valve position is regulated by an exhaust camshaft 34. The exhaust is treated in an exhaust system (not shown). Although single intake and exhaust valves 22,32 are illustrated, it can be appreciated that the engine 12 can include multiple intake and exhaust valves 22,32 per cylinder 18. An electric motor 36 provides an alternate source of power needed to rotate the crankshaft 28 of the engine 12. A control module 38 senses inputs from the engine system and responds by controlling the aforementioned components of the propulsion system 10.

Figure 2:
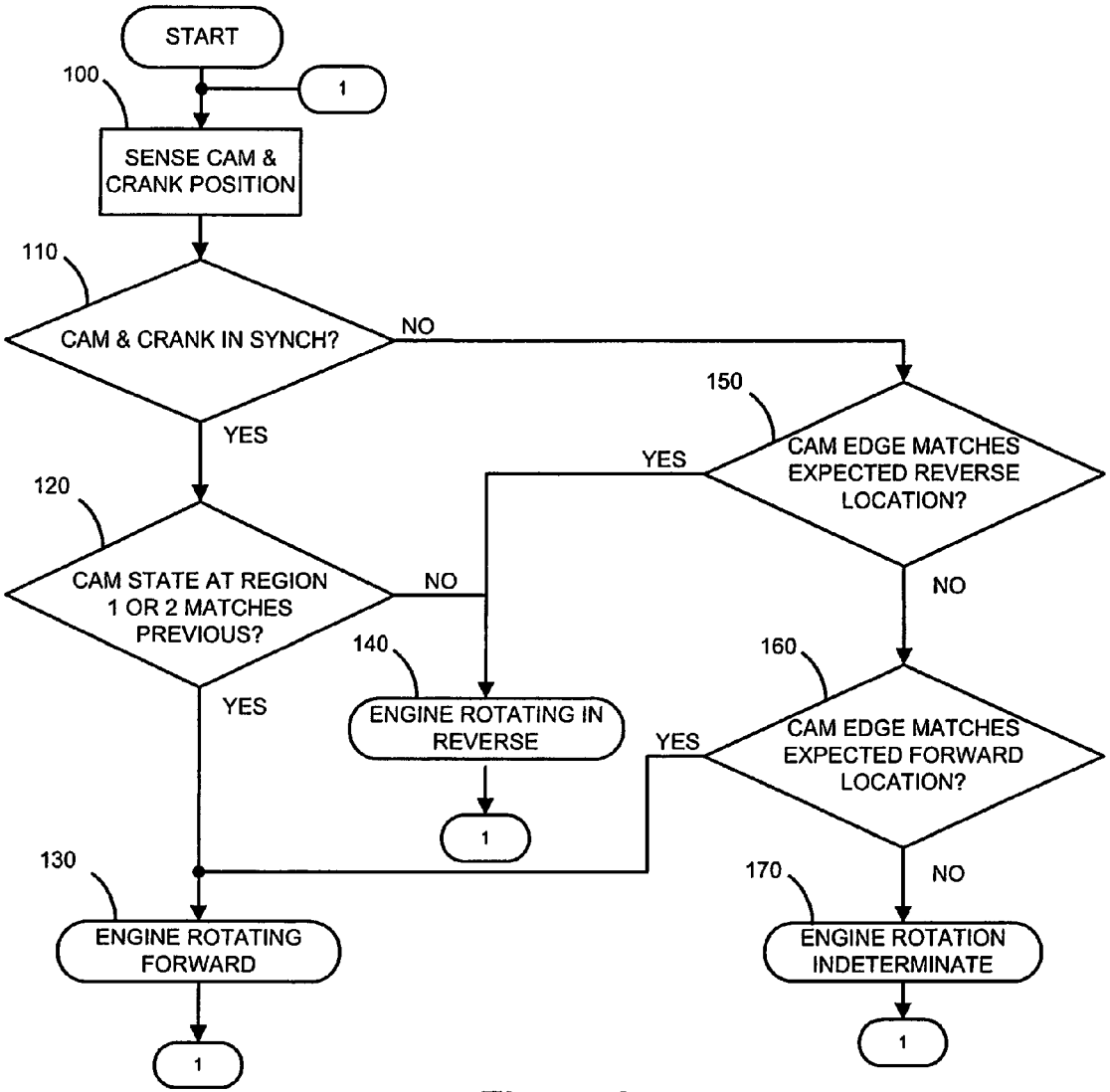
FIG. 2 is a flowchart illustrating the steps for identifying reverse rotation of an engine of the propulsion system.

Control module 38 can determine when the engine 12 is operating in reverse rotation by evaluating a pulse train signal generated by a cam sensor 40 and a pulse train generated by a crankshaft sensor 41. Referring now to FIGS. 1 and 2, the flow of control executed by the control module 38 according to the present invention will be described in more detail. In order to detect reverse rotation of an engine 12, control first determines an engine position that indicates whether the camshaft 24 and crankshaft 28 are synchronized. For purposes of clarity, the following discussion relates to the intake camshaft 24 (hereinafter referred to as camshaft 24). As can be appreciated, a similar approach can also be applied to the exhaust camshaft 34.

In step 100, the sensors sense the position of the camshaft 24 and the crankshaft 28. The. position of the camshaft 24 is determined relative to the position of the crankshaft 28. The camshaft and the crankshaft are synchronized if their states match a preselected pattern, and the engine has sustained it's own forward rotation as measured by crankshaft speed. If the camshaft 24 and crankshaft 28 are synchronized in step 110, a state of the camshaft signal is evaluated in step 120 for a selectable region defined by a first and a second angle of the camshaft 24. The state of the signal can be either high or low. In step 120, if an actual cam signal state matches a cam signal state previously sensed at the selectable region, the engine 12 is rotating in a forward direction at step 130. Otherwise if an actual cam signal state does not match a cam signal state previously sensed at the selectable region, the engine 12 is rotating in a reverse direction at step 140.

Referring back to step 110, otherwise, if the camshaft 24 and crankshaft 28 are not synchronized, in steps 150 and 160 an edge of the camshaft sensor signal is evaluated at a region defined by a first and a second angle of the crankshaft position referenced relative to top dead center of a cylinder 18. The reference cylinder 18 can be selectable. The signal edge can be either low to high or high to low. In step 150, if an actual camshaft signal edge matches an expected reverse camshaft signal edge for that region, the engine 12 is rotating in a reverse direction at step 140. Otherwise, in step 160, if an actual camshaft signal edge matches an expected forward camshaft signal edge for that region, the engine is rotating in a forward direction at step 130. Otherwise, the rotation of the engine 12 is indeterminate at step 170. The expected forward camshaft signal edge and the expected reversed camshaft signal edge can be selectable according to an angle of the camshaft.

Figure 3:
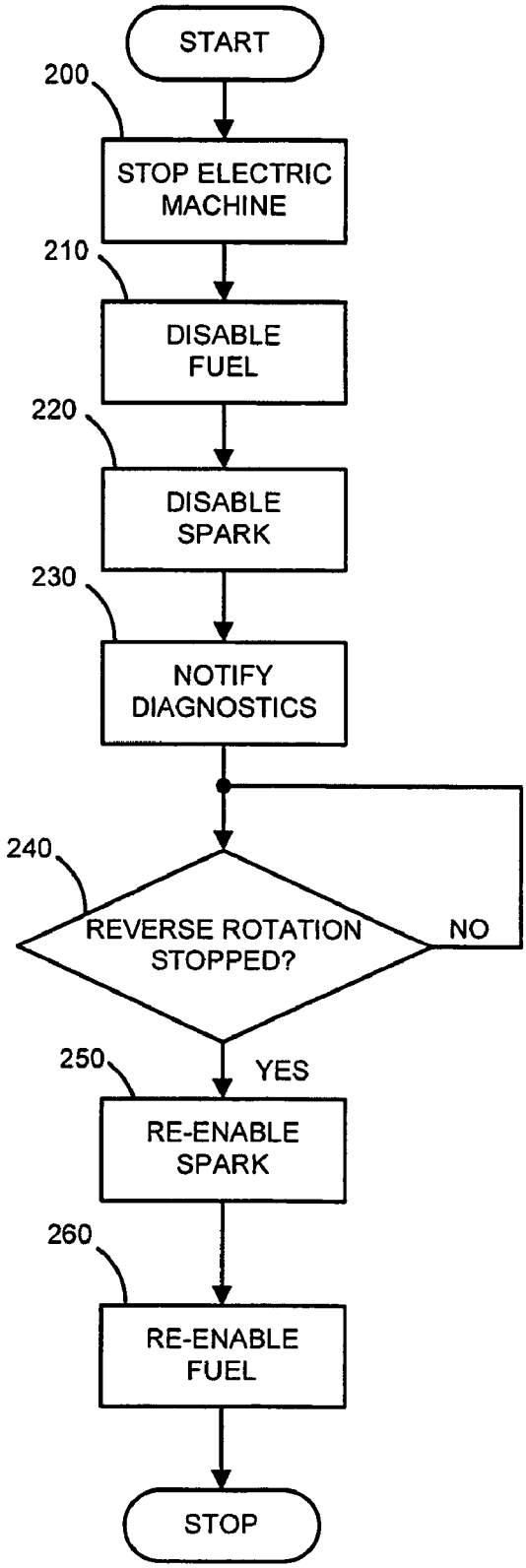
FIG. 3 is a flowchart illustrating the intake manifold protection method according to the present invention.

Referring now to FIGS. 1 and 3, once control determines the engine 12 is rotating in reverse, subsequent actions are taken to protect the intake manifold 14. FIG. 3 is a flowchart illustrating the steps taken by the control module 38. In step 200, control commands the electric motor 36 to stop reverse rotation. In step 210, control disables fuel by commanding the fuel injector 20 to cease operation. In step 220, control disables spark by commanding the spark plug 26 to cease firing. The actions of steps 210 and 220 are likely to occur at the same time. In step 230, control will notify an on-board diagnostic module of the reverse rotation condition. The diagnostic module can set a diagnostic code and perform any diagnostic functions if the diagnostic module determines to do so. Once reverse rotation has stopped 240, control re-enables fuel in step 250 by commanding the fuel injector 20 to inject fuel, re-enables spark in 260 by commanding the spark plug 26 to initiate combustion, and exits the loop.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An intake manifold protection system for a hybrid propulsion system with an internal combustion engine and an electric motor, comprising:

a fuel injector that supplies fuel to a cylinder of an engine;

a spark plug that that provides spark to said cylinder of said engine;

an electric motor; and a control module that determines when said engine is rotating in reverse and that commands said fuel injector and said spark plug off when said engine is rotating in reverse, wherein said control module commands said electric motor to cease operation when said engine is rotating in reverse.

2. The system of claim 1 wherein said engine further includes a crankshaft and wherein said electric motor is coupled to said crankshaft and wherein said control module commands said electric motor to rotate said crankshaft in a forward direction after said electric motor ceases operation.

3. The system of claim 1 wherein said control module notifies a diagnostic module of said reverse rotation.

4. The system of claim 1 wherein said control module confirms when said engine returns to rotating in forward direction.

5. The system of claim 4 wherein said control module commands said spark plug to re-enable and commands said fuel injector to re-enable.

6. An intake manifold protection system for a hybrid propulsion system including an engine that operates in a reverse rotational direction and an electric motor, comprising:

a cam sensor coupled to an engine that generates a cam sensor signal;

a crankshaft sensor coupled to said engine that generates a crankshaft sensor signal; and a control module that receives said cam sensor signal and said crankshaft sensor signal and that detects when said engine is operating in a reverse rotational direction based on said cam sensor signal and said crankshaft sensor signal and that sends a cease operation command when said engine is operating in said reverse rotational direction; and an electric motor, wherein said control module sends a forward direction command to said electric motor based on reverse rotation of said engine.

7. The system of claim 6 further comprising at least one spark plug wherein said control module sends said cease operation command to said at least one spark plug.

8. The system of claim 7 further comprising at least one fuel injector wherein said control module sends said cease operation command to said at least one fuel injector.

9. The system of claim 6 further comprising a diagnostic module wherein said control module notifies said diagnostic module of said reverse rotation.

10. The system of claim 6 wherein said control module commands a commence operation command.

11. The system of claim 6 wherein said control module sends said cease operation command to said electric motor.

12. The system of claim 6 wherein said control module confirms that reverse rotation of said engine has ceased after detection of said reverse rotation.

13. A method of protecting an intake manifold of an engine of a hybrid propulsion system including an electric motor, comprising:

detecting a reverse rotation of an engine;

commanding a fuel injector of said engine that is rotating in reverse to cease operation;

commanding a spark plug of said engine that is rotating in reverse to cease operation;

commanding an electric motor to cease reverse rotation of said engine; and confirming reverse rotation of said engine has ceased.

14. The method of claim 13 further comprising notifying a diagnostic module of said reverse rotation.

15. The method of claim 13 wherein commanding said electric motor to cease operation further comprises commanding said electric motor to begin forward rotation.

16. The method of claim 13 further comprising commanding said fuel injector to re-enable and commanding said spark plug to re-enable after confirming reverse rotation of said engine has ceased.

17. The method of claim 13 wherein detecting a reverse rotation comprises comparing an actual cam sensor signal to an expected cam sensor signal, and wherein said expected cam sensor signal is determined based on said actual cam sensor signal and a crankshaft sensor signal.

18. The method of claim 17 wherein said expected cam sensor signal is set to a previously stored actual cam sensor signal, and wherein detecting a reverse rotation further comprises comparing a state of said actual cam sensor signal to a state of said expected cam sensor signal while said engine is operating in at least one of a first region and a second region and when a camshaft and crankshaft are synchronized.

19. The method of claim 17 wherein said expected cam sensor signal is set to an expected reverse cam sensor signal, and wherein detecting a reverse rotation further comprises comparing an edge of said actual cam sensor signal to an edge of said expected cam sensor signal for a selected crank angle region relative to top dead center of a specified cylinder when a camshaft and crankshaft are not synchronized.

* * * * *